US005877737A

United States Patent [19]

Kim et al.

[11] Patent Number: 5,877,737

[45] Date of Patent: Mar. 2, 1999

[54] WIDE VIEWING ANGLE DRIVING CIRCUIT AND METHOD FOR LIQUID CRYSTAL DISPLAY

[75] Inventors: Tai-Sung Kim, Suwon-si; Sang-Soo Kim, Seoul, both of Rep. of Korea

[73] Assignee: Samsung Electronics Co., Ltd., Kyungki-Do, Rep. of Korea

[21] Appl. No.: 705,204

[22] Filed: Aug. 29, 1996

[30] Foreign Application Priority Data

Aug. 29, 1995 [KR] Rep. of Korea ..... 95-27161

[51] Int. Cl.[6] ..... G09G 3/18

[52] U.S. Cl. ..... 345/89; 345/63; 345/211

[58] Field of Search ..... 345/89, 87, 204, 345/147, 63, 77, 95, 96, 94, 208, 209, 211

[56] References Cited

U.S. PATENT DOCUMENTS 5,196,738 3/1993 Takahara et al. ..... 345/89
5,250,937 10/1993 Kikuo et al. ..... 345/89
5,625,387 4/1997 Moon ..... 345/89
5,640,174 6/1997 Kamei et al. ..... 345/209

*Primary Examiner*—Lun-Yi Lao
*Attorney, Agent, or Firm*—Pillsbury Madison & Sutro LLP

[57] ABSTRACT

A driving circuit and method for a display having a plurality of pixels includes generating first and second gray level voltages, supplying the first gray level voltages to a first set of the pixels to produce a first viewing angle characteristic, and supplying the second gray level voltages to a second set of the pixels to produce a second viewing angle characteristic. The first and second viewing angle characteristics are chosen such that they visually combine so as to widen an overall viewing angle of the display. The driving circuit and method according to the present invention achieves a wider viewing angle without increasing the manufacturing process complexity or cost and by adjusting only the peripheral circuits of the display.

14 Claims, 6 Drawing Sheets

WIDE VIEWING ANGLE DRIVING CIRCUIT AND METHOD FOR LIQUID CRYSTAL DISPLAY

BACKGROUND OF THE INVENTION

1. Field of the Invention

The present invention relates to a wide viewing angle driving circuit and method for a liquid crystal display, and more particularly, to a driving circuit and method which improves the viewing angle of a liquid crystal display (LCD) panel such that a screen can be viewed normally even at a variety of angles.

2. Description of the Related Art

Thin film transistor liquid crystal displays (TFT-LCDs) provide many advantages over cathode ray tubes (CRTs), but they also possess some weaknesses which have slowed the development of their technology. One problem is that the brightness of a screen is appears differently according to the angle at which the screen is viewed. For example, black and white contrast inversion sometimes occurs in which black and white color images are inverted when a screen is viewed over a certain range of angles.

Therefore, for liquid crystal displays to gain more favor for use in televisions and other applications, their viewing angle must be improved so that the screen can be viewed normally without degrading the brightness from a wider variety of angles.

Various attempts have been made to improve the viewing angle of liquid crystal displays. For example, methods have been devised for improving the viewing angle by arranging the angle in which the liquid crystal material of a LCD pixel is oriented by a process called "rubbing." In one common method, different rubbings are performed for each pixel. Another common method applies different directions of rubbing after dividing pixels into units. FIG. 1A shows the method of applying different rubbings (i.e., the rubbing angles of 1 and 2 are different from each other) for each pixel and FIG. 1B shows the method for applying different rubbing directions after dividing a pixel into two or more units (3 and 4).

FIG. 1C shows another conventional method which aims to improve a wide viewing angle by differentiating the storage capacitor volume of each pixel and by changing the voltage maintenance characteristic of pixels (i.e., the storage capacitor volumes of pixel A and pixel B are different from each other).

These conventional methods have disadvantages in that the manufacturing process becomes quite complex because rubbings must be performed twice or more, and the screen quality of the liquid crystal display is degraded by after-images and flicker and the like.

Therefore, there remains a need in the art for a liquid crystal display which effectively and simply provides an increased viewing angle. The present invention satisfies this need.

SUMMARY OF THE INVENTION

Accordingly, the present invention aims to solve the problems relating to a limited viewing angle in conventional liquid crystal displays.

One object of the present invention is to provide a driving circuit and method which increases the viewing angle of a liquid crystal display.

Another object of the present invention is to provide a wide viewing angle driving circuit and method for a liquid crystal display which does not require an increase in the complexity or cost of manufacturing a liquid crystal display panel.

Another object of the present invention is to provide a wide viewing angle driving circuit and method for a liquid crystal display which does not generate the problems of light leakage and after-images such as those commonly resulting from a rubbing process.

Another object of the present invention is to provide a driving circuit and method which increases the viewing angle of a liquid crystal display by changing only the peripheral circuits of the display.

To achieve these and other objects, a driving circuit and method for a display having a plurality of pixels includes generating first and second gray level voltages, supplying the first gray level voltages to a first set of the pixels to produce a first viewing angle characteristic, and supplying the second gray level voltages to a second set of the pixels to produce a second viewing angle characteristic. The first and second viewing angle characteristics are chosen such that they visually combine so as to widen an overall viewing angle of the display. The driving circuit and method according to the present invention achieves a wider viewing angle without increasing the manufacturing process complexity or cost and by adjusting only the peripheral circuits of the display.

BRIEF DESCRIPTION OF THE DRAWINGS

The present invention will become completely understood with reference to the following detailed description, and the attached drawings, in which.

DETAILED DESCRIPTION OF THE PREFERRED EMBODIMENTS

Figure 3:
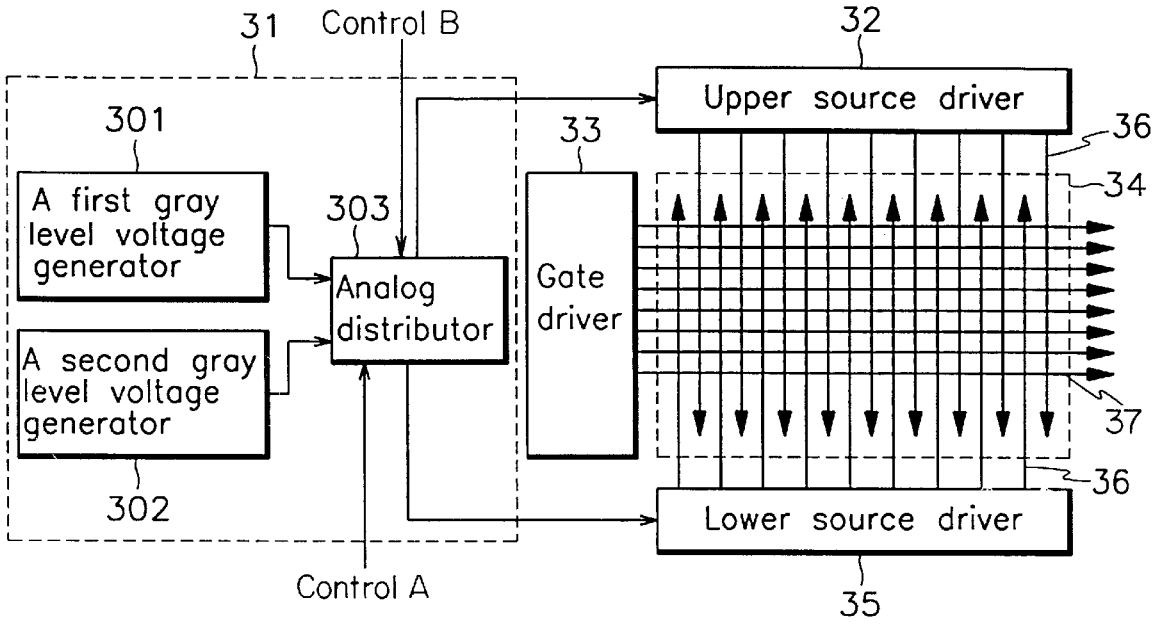
FIG. 3 is a block diagram of a liquid crystal display device employing a wide viewing angle driving circuit in accordance with a preferred embodiment of the present invention.

FIG. 3 illustrates a wide viewing angle driving circuit 31 that has been applied to a liquid crystal display device panel in accordance with a preferred embodiment of the present invention.

As shown in FIG. 3, the wide viewing angle driving circuit 31 in accordance with the preferred embodiment of the present invention includes a first gray level voltage generator 301 which outputs first data gray level voltages which, when applied to the display panel 34, cause pixels on the upper side of the display to have maximum brightness, as will be explained in more detail below. A second gray level voltage generator 302 outputs second data gray level voltages which, when applied to the display panel 34, cause pixels on the lower side of the display to have maximum brightness. An analog distributor 303 receives the first gray level voltages G0—Gn+1 from the first gray level voltage generator 301 and the second gray level voltages G0'—Gn+1' from the second gray level voltage generator 302, and outputs the gray level voltages to the upper and lower source drivers 32 and 35 with a regular cycle according to an external control signal (Control, Control B).

Figure 5A:
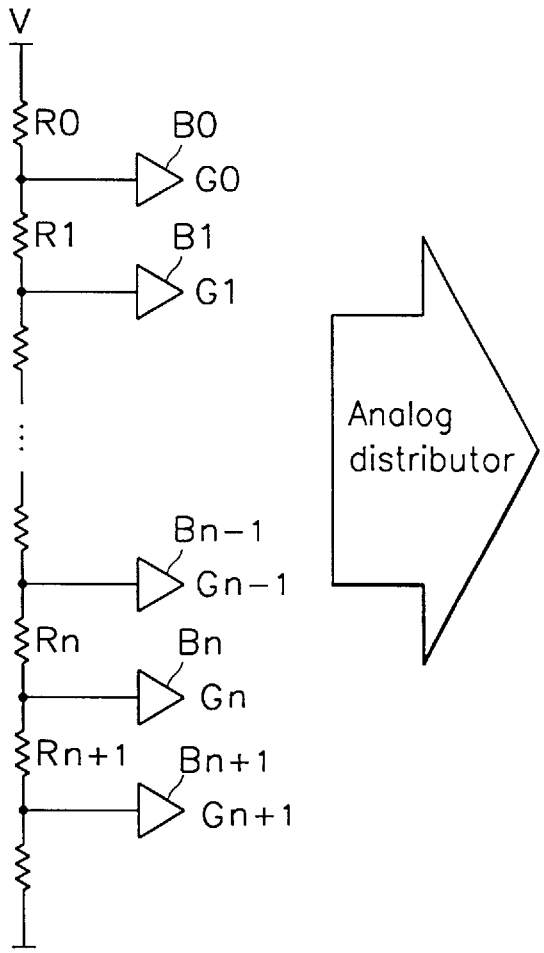
FIGS. 5*a*–5*b* are diagrams showing gray level voltage generators of a wide viewing angle driving circuit in accordance with a preferred embodiment of the present invention.
Figure 5B:
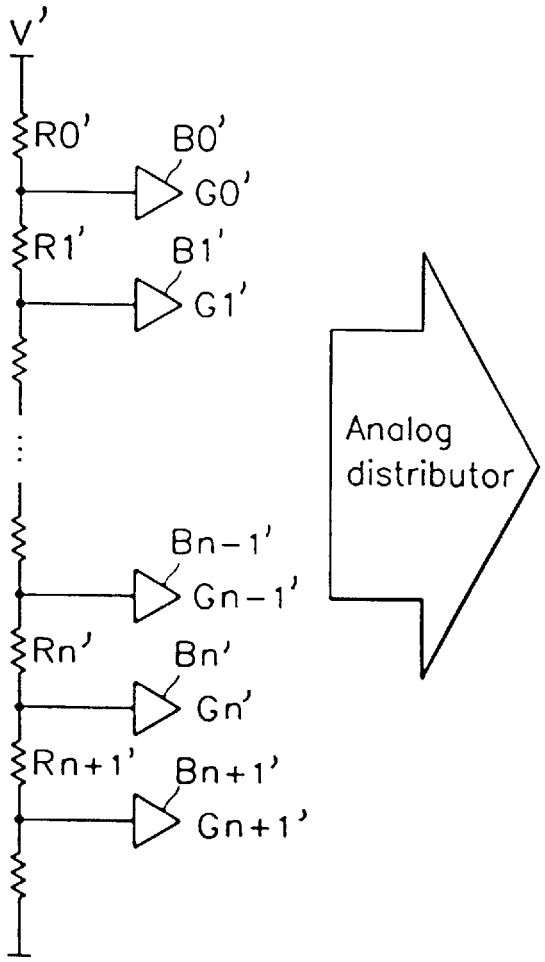

FIG. 5*a* is a diagram of a gray level voltage generator in a wide viewing angle driving circuit 31 in accordance with a preferred embodiment of the present invention. As illustrated in FIG. 5*a*, the first gray level voltage generator 301, preferably includes a plurality of resistors R0—Rn+1 connected in series to an electrical source V, and a plurality of buffers B0—Bn+1 which are connected in parallel to the plurality of resistors R0—Rn+1 and which output gray level voltages G0—Gn+1. It should be noted that the voltage level of gray level voltage G0 is less than the level of V by the amount of voltage drop across resistor R0, G0 is greater than the voltage level of gray level voltage G1 by the voltage drop across the resistor R1, G1>G2, etc. As illustrated in FIG. 5*b*, the second gray level voltage generator 302 preferably includes a plurality of resistors R0'—Rn+1' connected in series to an electrical source V', and a plurality of buffers B0'—Bn+1' which are connected in parallel to the plurality of resistors R0'—Rn+1' and which output gray level voltages G0'—Gn+1'. The voltage level of gray level voltage G0' is less than the level of V' by the amount of voltage drop across resistor R0', and G0' is greater than the voltage level of gray level voltage G1' by the voltage drop across the resistor R1'. In a similar manner, gray level voltage G1' is greater than gray level voltage G2'.

Figure 6:
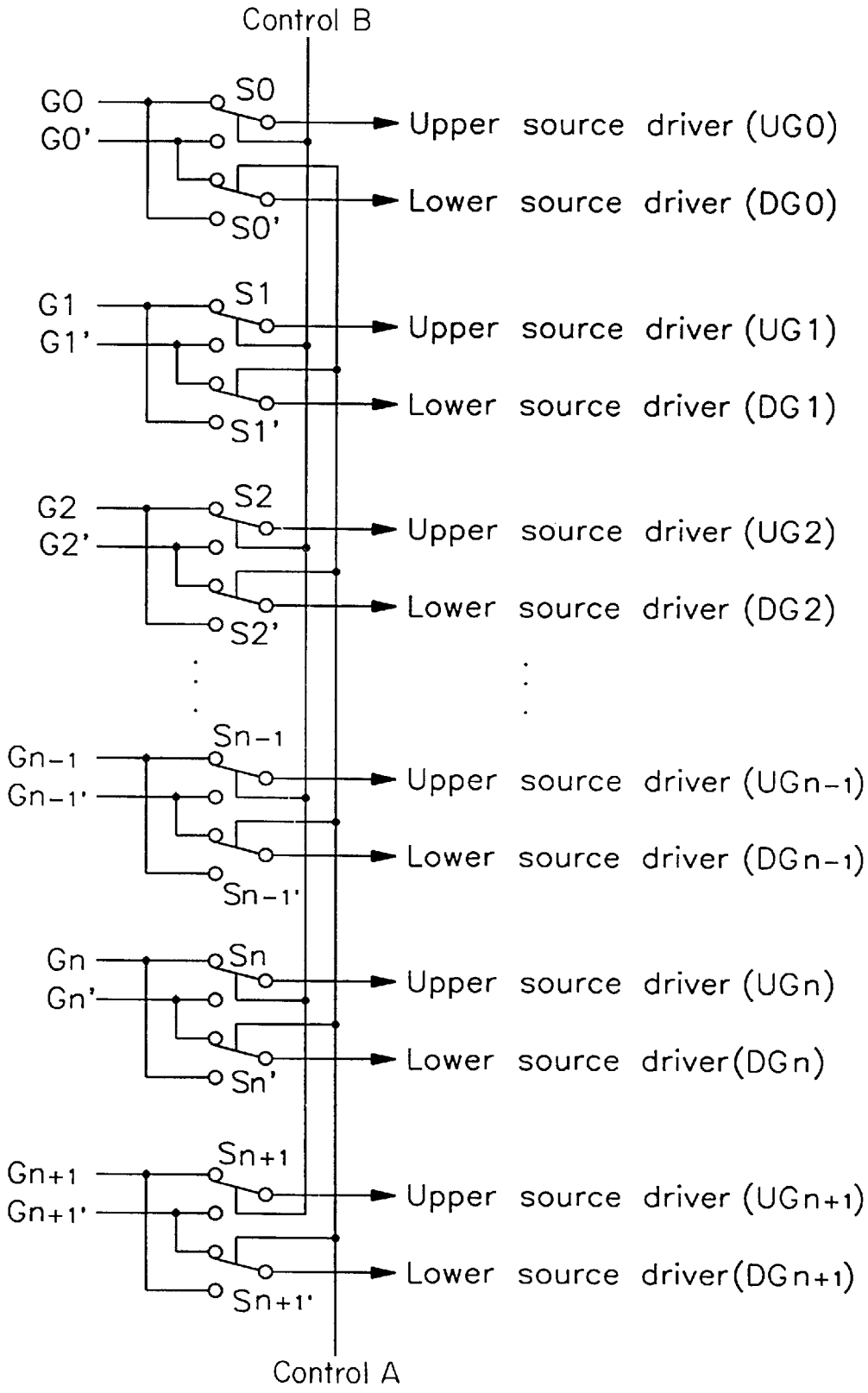
FIG. 6 is a diagram showing an analog distributor of a wide viewing angle driving circuit in accordance with a preferred embodiment of the present invention.

FIG. 6 is a diagram of an analog distributor of a wide viewing angle driving circuit in accordance with a preferred embodiment of the present invention. As illustrated in FIG. 6, in a wide viewing angle driving circuit 31 in accordance with the preferred embodiment of the present invention, an analog distributor 303 preferably includes a plurality of switches S0'—Sn+1' which respectively switch between the first gray level voltages G0—Gn+1 output from first gray level voltage generator 301 and the second gray level voltages G0'—Gn+1' output from second gray level voltage generator 302 according to the control signal (control A), and transmits gray level voltages to a source driver 35 located on the lower side of a panel 34; and a plurality of switches S0—Sn+1 which respectively switch between the first gray level voltages G0—Gn+1 output from first gray level voltage generator 301 and the second gray level voltages G0'—Gn+1' output from second gray level voltage generator 302 according to the control signal (control B), and transmits gray level voltages to a source driver 32 located on the upper side of a panel 34.

With reference to FIG. 3, the operation of a TFT-LCD having a wide viewing angle driving circuit in accordance with a preferred embodiment of the present invention will be explained as follows. A TFT-LCD panel comprises a plurality of rows and columns in which are arranged a plurality of pixels. As shown in FIG. 3, source driver integrated circuits 32 and 35 are respectively arranged on the upper and lower sides of panel 34 to drive the above-mentioned pixels, gate driver 33 drives the switching elements (e.g., TFT devices) which turn on or off data between respective pixels, a plurality of data lines 36 formed between driver integrated circuits 32, 35 and respective pixels arranged in the column direction, and a plurality of gate lines 37 formed between gate driver integrated circuit 33 and respective pixels arranged in the row direction. It should be noted that although the source drivers 32, 35 are shown as being located on the upper and lower portions of the panel, that other configurations are possible. For example, the source drivers may be located on the right and left portions so that the data lines extend in the horizontal direction rather than the vertical direction.

When the gate driver integrated circuit 33 successively turns on one each of the gate lines, the source driver integrated circuits 32, 35 output display data through data lines connected to the plurality of pixels. As a result, the polarity of the data voltage is inverted against the common electrode voltage with a regular cycle and an image is formed on the panel. The most widely used data line inversion is a method in which the polarity of data voltages outputted for one horizontal line of pixels is inverted with respect to the polarity of the data voltages outputted for the next adjacent horizontal line of pixels with respect to the voltage applied to the common electrode connected to all pixels.

It should be noted that one feature of liquid crystal displays, as recognized and exploited by the present invention, is that the viewing angle of the liquid crystal material is varied in accordance with the level of driving voltage applied to the liquid crystal material. Accordingly, the present invention provides a circuit for driving a liquid crystal display device which displays an image with a wide viewing angle by applying appropriate voltages to the pixels according to the inputted gray level data voltages and adjusts the light transmitting characteristic of pixels in accordance with their location with respect to the horizontal and vertical cross sections of the screen. This is accomplished by supplying appropriate gray level data voltages to the drive integrated circuits for driving the pixels which are located on the upper and lower (or, the left and right) sides of the liquid crystal display panel. The appropriate data voltages are provided by generating two or more different gray level voltages from the above-described gray level voltage generator circuits and applying the different gray level voltages to the respective pixels in a specific arrangement.

One example of a method for improving the viewing angle of a display according to the present invention is described as follows. When a display features maximum brightness distributed toward the upper and the lower sides as shown in FIGS. 2A and 2B, respectively, the screen is viewed well from the upper side if the distribution of gray level voltages to the pixels in the display is adjusted appropriately such that a brightness distribution like FIG. 2A is formed, and the screen is viewed well from the lower side if the distribution of brightness is like that in FIG. 2B.

Figure 2A:
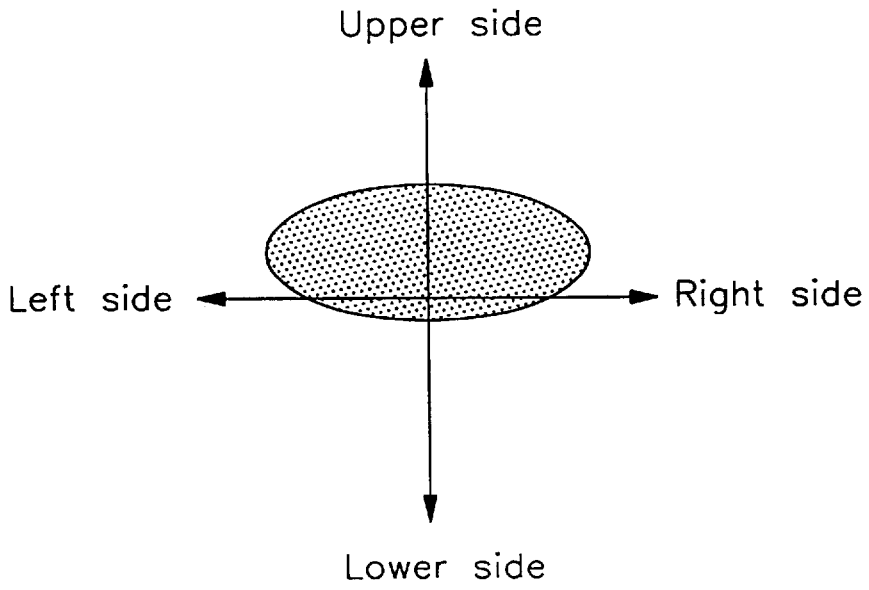
FIG.2A (Prior Art)
FIGS. 2A and 2B illustrate a viewing angle distribution of a conventional liquid crystal display device.
Figure 2B:
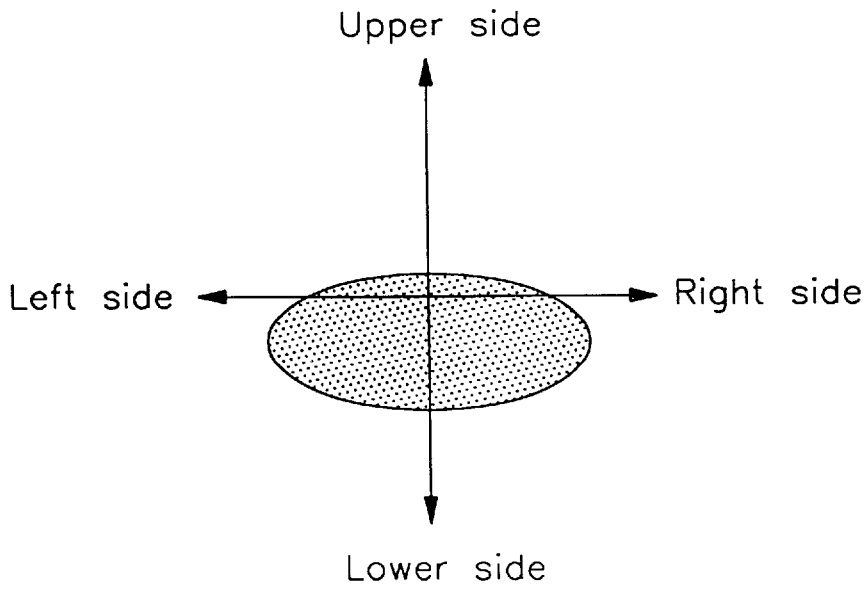
FIG.2B (Prior Art)

Accordingly, the outputs of the first gray level voltage generator 301 of FIG. 3 are applied to the pixels of the display in such a fashion so as to produce the viewing angle characteristic like FIG. 2A and the outputs of the second gray level voltage generator 302 of FIG. 3 are applied to the pixels of the display in such a fashion so as to produce the viewing angle characteristic like that of FIG. 2B. The analog distributor 303 of FIG. 3 supplies the gray level voltages to the upper source driver and the lower source driver with a regular cycle according to the external control signal (control A, control B). Accordingly, gray level data voltages resulting in two different viewing angle characteristics are controllably inputted to the pixels in the panel 34 of FIG. 3.

Figure 1A:
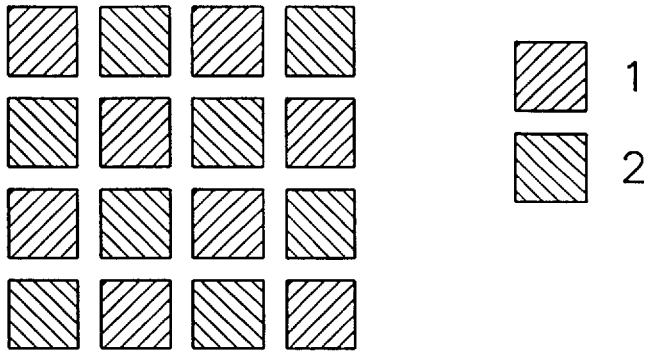
FIG. 1A (Prior Art)
FIGS. 1A–1C illustrate the conventional methods used to increase a wide viewing angle.
Figure 1B:
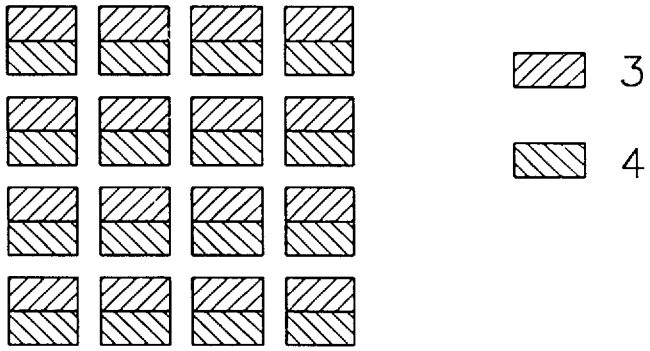
FIG. 1B (Prior Art)
Figure 1C:
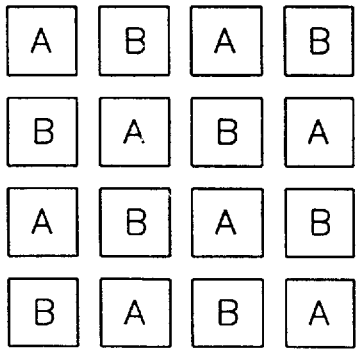
FIG. 1C (Prior Art)
Figure 4:
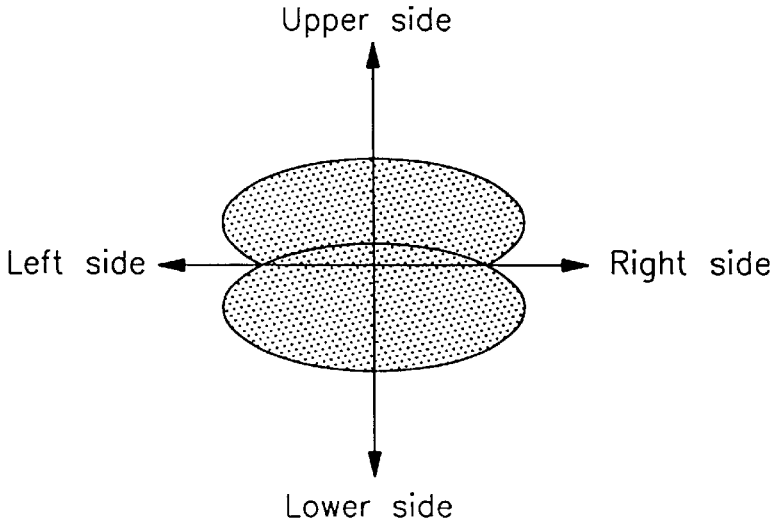
FIG. 4 illustrates a viewing angle distribution of a liquid crystal display device employing a wide viewing angle driving circuit in accordance with a preferred embodiment of the present invention.

For example, the first gray level voltages of the first gray level voltage generator 301 can be applied to pixels in locations corresponding to pixels of type 1 of FIG. 1A and the second gray level voltages of the second gray voltage generator 302 can be applied to pixels in locations corresponding to pixels of type 2 of FIG. 1A. Therefore, the analog distributor, in accordance with the external control signal (control A, control B), applies the different first gray level voltages output from the first gray level voltage generator to appropriate vertical lines of pixels 1 to obtain the viewing angle characteristic such as that shown in FIG. 2A, and applies the different second gray level voltages output from the second gray level voltage generator to appropriate vertical lines of pixels 2 to obtain the viewing angle characteristic such as that shown in FIG. 2B. Therefore, a person viewing the screen collectively feels that the viewing angle distributions toward the upper and lower sides are combined and widened to obtain the overall characteristic shown in FIG. 4 by the ordinary nature of light. Moreover, a screen of a wider range can be viewed because the viewing angle is adjusted to be symmetrical toward the upper and lower directions.

As shown in the preferred embodiment, the present invention provides a wide viewing angle driving circuit and method for a liquid crystal display which does not require an increase in the manufacturing process complexity or cost, and can improve a viewing angle by adjusting only the peripheral circuits of the display.

The effects of the present invention can be effectively applied in the field of liquid crystal display devices, although it should be apparent that the principles of the invention are not limited to these types of displays.

Although the present invention has been described in detail with reference to the preferred embodiments thereof, those skilled in the art will readily appreciate that various substitutions and modifications can be made thereto without departing from the spirit and scope of the invention as set forth in the appended claims.

We claim:

1. A driving circuit for a display having a plurality of pixels, comprising:

a first gray level voltage generator which outputs first gray level voltages;

a second gray level voltage generator which outputs second gray level voltages; and an analog distributor which receives said first gray level voltages from said first gray level voltage generator and said second gray level voltages from said second gray level voltage generator, and which supplies them to first and second sets of said pixels, respectively, such that said first set of said pixels produces a first viewing angle characteristic and said second set of said pixels produces a second viewing angle characteristic, said first and second viewing angle characteristics visually combining to widen an overall viewing angle of said display.

2. A driving circuit as defined in claim 1, wherein said first gray level voltage generator and said second gray level voltage generator each include:

a plurality of resistors connected to a voltage source in series; and a plurality of buffers respectively connected to said plurality of resistors, and in parallel with each other, and which each output a respective gray level voltage.

3. A driving circuit as defined in claim 1, wherein said analog distributor includes a plurality of switches which, according to an external control signal, switch among said first gray level voltages from said first gray level voltage generator and said second gray level voltages from said second gray level voltage generator, respectively, so as to selectively transmit one of said first and second gray level voltages to a corresponding one of said first and second sets of said pixels.

4. A driving circuit as defined in claim 1, further comprising:

a first source driver connected to said analog distributor which supplies said first and second gray level voltages to a first set of data lines; and a second source driver connected to said analog distributor which supplies said first and second gray level voltages to a second set of data lines.

5. A driving circuit as defined in claim 4, wherein said analog distributor includes:

a plurality of first switches which, according to a first external control signal, switch among said first gray level voltages from said first gray level voltage generator and said second gray level voltages from said second gray level voltage generator, respectively, so as to selectively transmit one of said first and second gray level voltages to a corresponding one of said first and second sets of pixels through said first source driver; and a plurality of second switches which, according to a second external control signal, switches between said first gray level voltages from said first gray level voltage generator and said second gray level voltages from said second gray level voltage generator, respectively, so as to selectively transmit one of said first and second gray level voltages to a corresponding one of said first and second sets of pixels through said second source driver.

6. A driving circuit according to claim 1, wherein said first viewing angle characteristic is that said display has maximum brightness when viewed from an upper side, and said second viewing angle characteristic is that said display has maximum brightness when viewed from a lower side.

7. A driving circuit according to claim 1, wherein said first viewing angle characteristic is that said display has maximum brightness when viewed from a left side, and said second viewing angle characteristic is that said display has maximum brightness when viewed from a right side.

8. A driving circuit as defined in claim 1, wherein said first and second viewing angle characteristics are symmetrical about an axis in said display.

9. A driving method for a display having a plurality of pixels, comprising:

generating first gray level voltages;

generating second gray level voltages; and supplying said first gray level voltages to a first set of said pixels to produce a first viewing angle characteristic and supplying said second gray level voltages to a second set of said pixels to produce a second viewing angle characteristic which visually combines with said first viewing angle characteristic so as to widen an overall viewing angle of said display.

10. A driving method as defined in claim 9, wherein said first gray level voltage generating step and said second gray level voltage generating step each include:

receiving a voltage source;

stepping down said voltage source by a plurality of predetermined amounts to produce gray level voltages respectively having a plurality of predetermined voltage levels; and outputting said gray level voltages.

11. A driving method as defined in claim 9, wherein said step of supplying said first and second gray level voltages includes:

receiving an external control signal;

receiving said first and second gray level voltages;

switching among said first and second gray level voltages in accordance with said external control signal so as to selectively transmit one of said first and second gray level voltages to a corresponding one of said first and second sets of said pixels.

12. A driving method according to claim 9, wherein said first viewing angle characteristic is that said display has maximum brightness when viewed from an upper side, and said second viewing angle characteristic is that said display has maximum brightness when viewed from a lower side.

13. A driving circuit according to claim 9, wherein said first viewing angle characteristic is that said display has maximum brightness when viewed from a left side, and said second viewing angle characteristic is that said display has maximum brightness when viewed from a right side.

14. A driving method as defined in claim 9, wherein said first and second viewing angle characteristics are symmetrical about an axis in said display.

* * * * *